United States Patent [19]

Grachtrup et al.

[11] Patent Number: 4,915,311

[45] Date of Patent: Apr. 10, 1990

[54] ROLLER MILL

[75] Inventors: Heinz Grachtrup; Otto Heinemann, both of Ennigerloh; Helmut Krumme, Wadersloh; Helmut Lücke, Beckum; Werner Schössler, Ahlen; Karl von Greiffenstern, Beckum, all of Fed. Rep. of Germany

[73] Assignee: Krupp Polysius AG, Fed. Rep. of Germany

[21] Appl. No.: 310,904

[22] Filed: Feb. 16, 1989

[30] Foreign Application Priority Data

Feb. 26, 1988 [DE] Fed. Rep. of Germany ..... 3806159

[51] Int. Cl.[4] ..... B02C 4/02

[52] U.S. Cl. ..... 241/226

[58] Field of Search ..... 241/224, 225, 226, 227, 241/300

[56] References Cited

U.S. PATENT DOCUMENTS 1,795,663 3/1931 McGregor ..... 241/226

4,838,494 6/1989 Jakobs ..... 241/226

FOREIGN PATENT DOCUMENTS 3635762 4/1988 Fed. Rep. of Germany ..... 241/226

*Primary Examiner*—Mark Rosenbaum

*Attorney, Agent, or Firm*—Learman & McCulloch

[57] ABSTRACT

The invention relates to a roller mill with two rollers, a grinding gap formed thereby and a material inlet shaft the end walls of which bear on their lower ends carrier plates with replaceable sintered metal wear parts. Each wear part is formed by a plurality of small sintered metal plates of small area which are set close against one another like a mosaic and are individually screwed onto the carrier plate so that in case of wear only those small sintered metal plates which are actually worn can be replaced simply, quickly and economically.

7 Claims, 3 Drawing Sheets

ROLLER MILL

The invention relates to a roller mill for high pressure comminution of material for subsequent grinding, such mill being provided with an improved wear plate assembly associated with the opposite end faces of the rotatable rollers.

BACKGROUND OF THE INVENTION

In roller mills of the known type the material for grinding which is to be comminuted under high pressure in the roller gap is delivered to this roller gap from above with the aid of a material inlet shaft. The material inlet shaft is generally rectangular in cross-section and has two end walls which are associated with the two opposing roller end walls to ensure that the roller gap formed by the grinding rollers is covered as closely as possible at the ends.

Because of the relatively high speed at which the material for grinding is drawn in and the high grinding pressure which is exerted on the material in the region of the grinding gap, the corresponding regions of the shaft end walls are subject to relatively high wear stresses. For this reason each shaft end wall has a releasably fixed carrier plate on which a plate-shaped wear part which covers the wedge region of the grinding gap at the end and is made from suitable wearing material, especially sintered metal, is provided so that a sort of wear-resistant armouring is produced in these wedge regions. For the construction of these wear parts not only have various wearing materials been tried out but also a plurality of means for fixing these wear parts on the carrier plate. The latter is important so that used wear parts can be replaced simply and quickly. In the past plates having a sufficiently large area, especially sintered metal plates, were generally used as wear parts. However, it was repeatedly shown that plates which are stuck on fall out and plates which are soldered on are broken away; even costly clamping of sintered metal plates by means of dovetail joints frequently leads to fractures.

Apart from these disadvantages as regards the fixing it is generally necessary to throw away the plates which are frequently only partly worn or broken off and replace them by new plates.

The object of the invention, therefore, in a roller mill is to construct particularly the material inlet shaft with its end walls and the carrier plates supported thereon with the plate-shaped wear parts in such a way that with relatively simple design and quick and economical way of replacing simple plate-shaped wear parts and an extremely reliable fixing of these wear parts on the appertaining carrier plates is ensured.

SUMMARY OF THE INVENTION

According to the invention the individual wear parts are no longer formed by sintered metal plates having a large area as in the known constructions described above, but by a plurality of small sintered metal plates having a small area which are set close against one another like a mosaic and are screwed onto the appertaining carrier plate so as to be individually releasable. Since each of these small sintered metal plates only forms a relatively small working surface, they can be fixed extremely reliably by the appertaining fixing screw on the carrier plate. Then if—as is generally the case—only a part of the total area formed by all the small sintered metal plates on one carrier plate is worn to the extent that a replacement is necessary, then only the individual small sintered metal plates which are largely or completely worn need to be replaced, whilst the remaining small sintered metal plates on this carrier plate can remain in place. Such replacement of worn small sintered metal plates proves very economical on material and therefore in cost. The replacement of the individual small sintered metal plates can be carried out extremely simply and quickly by means of the appertaining fixing screws.

A further advantage may also be seen in the fact that all the small sintered metal plates can be constructed so as to be the same size, so that production, procurement and storekeeping thereof can be greatly reduced in cost and simplified.

THE DRAWINGS

The invention will be explained in greater detail below with the aid of the drawings. In these drawings.

DETAILED DESCRIPTION

Figure 1:
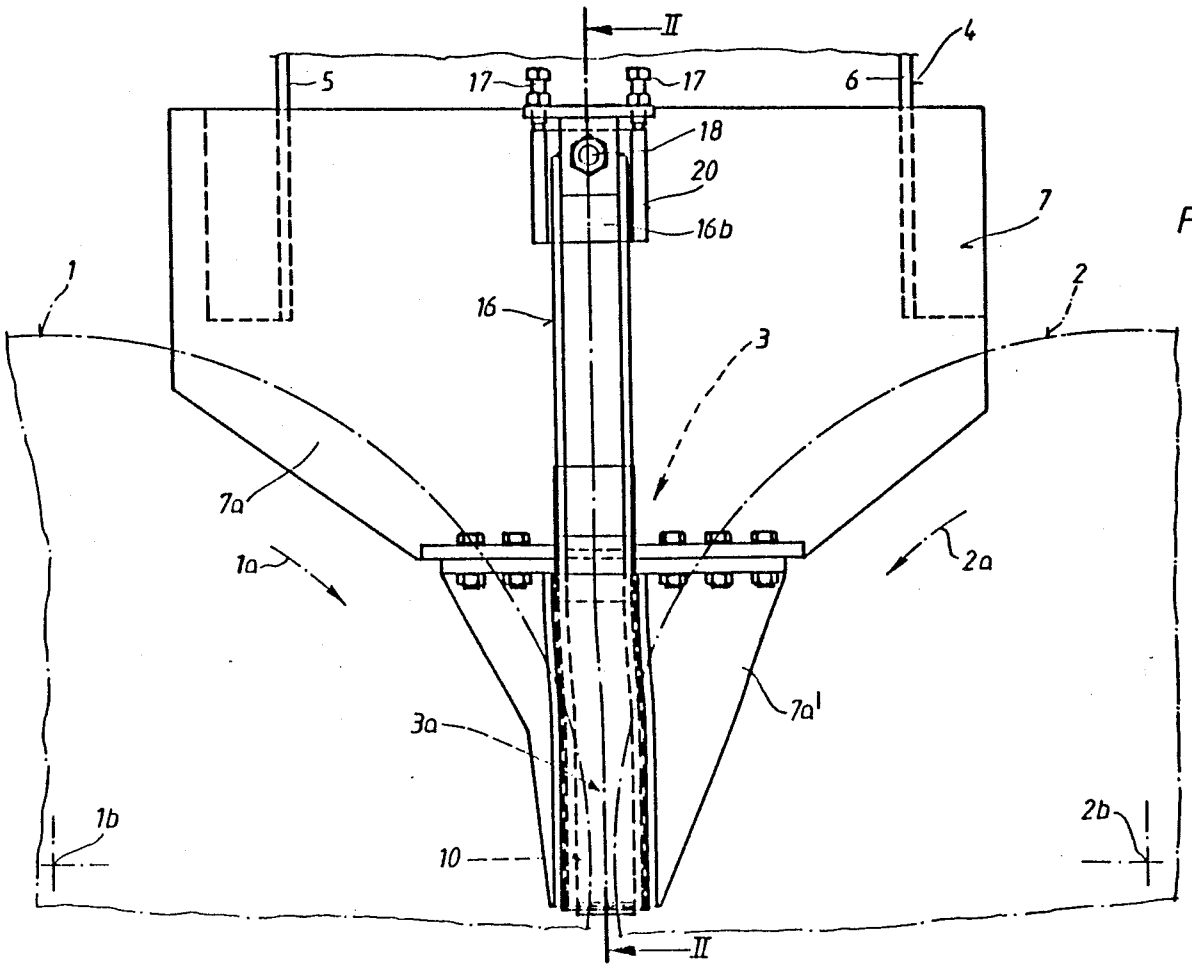
FIG. 1 shows a partial end view of the roller mill, particularly to show one end wall of the material inlet shaft associated with the two rollers.
Figure 2:
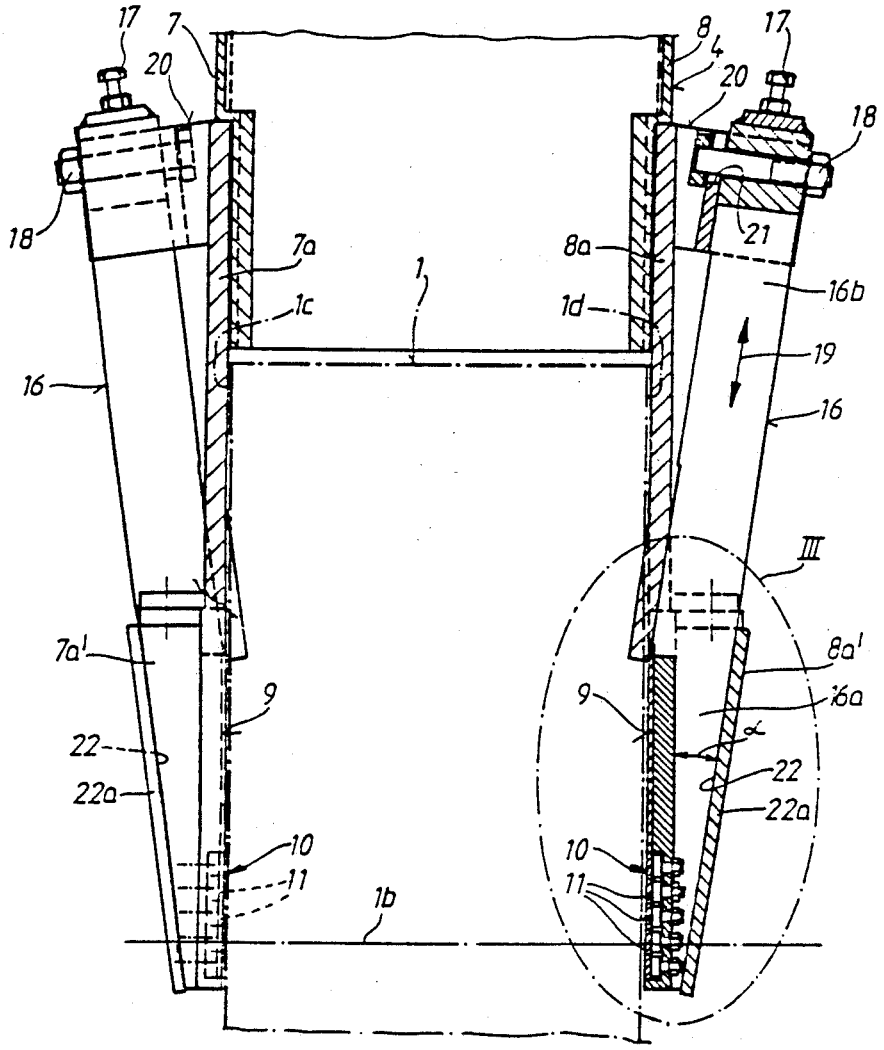
FIG. 2 shows a sectional view of the roller mill approximately along the line II—II in FIG. 1.

Essentially only those parts which are considered necessary for the explanation of the invention are illustrated in the views shown in FIGS. 1 and 2; the other parts of the roller mill, that is to say for example the housing, the mounting of the rollers, the drive for the rollers, etc. can be constructed in a manner which is known per se. The illustrated roller mill which is described below should in particular be the type of roller mill in which comminution under pressure (which is known per se) of material for grinding, above all relatively brittle material for grinding, can be carried out.

According to the partial views of FIGS. 1 and 2 the roller mill contains two rollers which are only indicated by dash-dot lines, namely a so-called idle roller 1 and a so-called fixed roller 2, which rotate in opposite directions according to the directional arrows 1*a* and 2*a*.

These two rollers 1, 2 form a roller gap 3 in the region between them and their respective upper shell surfaces.

Furthermore, the roller mill contains a material inlet shaft 4 which delivers the material for grinding from above to the grinding gap 3 and has two longitudinal walls 5 and 6 which are arranged spaced from one another and run substantially parallel to the roller axes 1b and 2b as well as two end walls 7 and 8 which run approximately at right angles thereto, are constructed for covering (sealing) the ends of the grinding gap 3 and associated with the end faces (cf. roller end faces 1c and 1d in FIG. 2) of the rollers.

Each shaft end wall 7, 8 is of the same construction in principle, and these two end walls can be constructed in mirror image with respect to each other—adapted to the end of the idle roller and the end of the fixed roller. Each shaft end wall 7, 8 has a similar carrier plate 9 which is releasably fixed on it with a plate-shaped wear part 10 which covers the wedge region 3a of the grinding gap 3 provided on the lower end section of the carrier plate.

Figure 3:
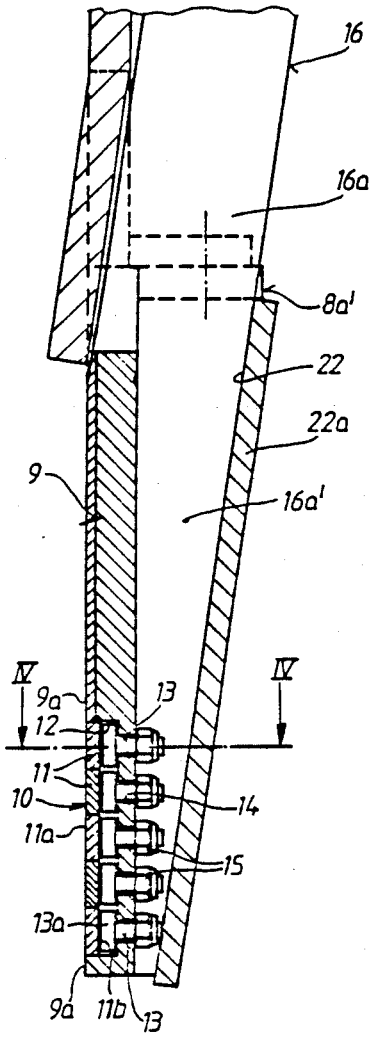
FIG. 3 shows an enlarged sectional view in detail through the lower end of one shaft end wall, approximately corresponding to the section III in FIG. 2.
Figure 4:
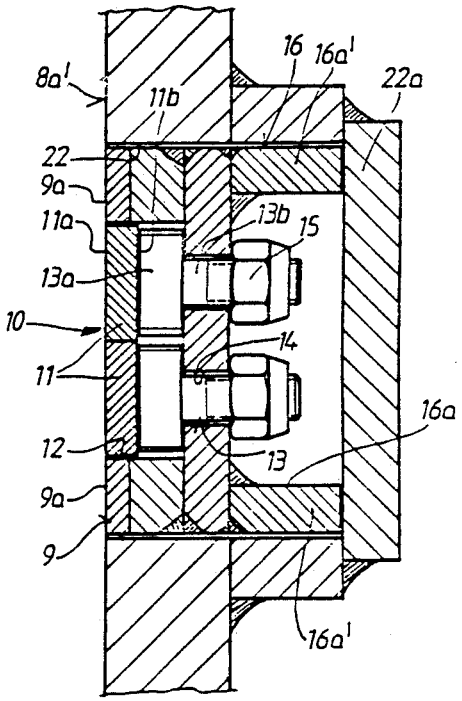
FIG. 4 shows a cross-sectional view along the line IVIV in FIG. 3.

As shown above all in the sectional views of the details in FIGS. 3 and 4 on an enlarged scale, each wear part 10 is essentially formed by a plurality of small sintered metal plates 11 having a small area which are set close against one another like a mosaic. These small sintered metal plates 11 all have a rectangular plan form or a rectangular surface facing the roller end faces. These small sintered metal plates 11 are arranged formlockingly in a recess 12 in the carrier plate 9 in such a way that they form a flat, tightly closed cover surface 11a for the wedge region 3a of the grinding gap, and this cover surface 11a lies substantially flush with the side surfaces 9a of the carrier plate 9 which surround it.

A fixing screw 13 by means of which each small sintered metal plate is individually (itself) releasably connected to the carrier plate is fixed on the rear face 11b of each small sintered metal plate 11 facing away from the grinding gap wedge region 3a or the cover surface 11a. The fixing screw 13 is soldered with its screw head 13a flat on the rear face 11b of the appertaining small sintered metal plate 11 in such a way that the threaded shank 13b of the fixing screw 13 in each case projects approximately at right angles from the rear face 11b of the small plate towards the rear. Thus the threaded shank 13b of each fixing screw 13 passes through a matching hole 14 in the carrier plate 9 to the extent that on the rear of the carrier plate 9 a lock nut 15 can be screwed onto the threaded shank 13b in order to fix the appertaining small sintered metal plate 11 reliably but releasably on the carrier plate 9 in its recess 12, as can be seen particularly well from FIGS. 3 and 4.

Above all the illustration in FIG. 2 shows that the carrier plate 9 bearing the small sintered metal plates 11 is provided at the lower end 16a of a plug-in part which is constructed in any suitable manner like a profiled beam, preferably like a U-shaped profiled beam (in this cf. connection FIG. 4). At its upper end 16b each plug-in part is retained so as to be adjustable in height (double arrow 19) by means of set screws 17 and fixing screws 18 on the appertaining shaft end wall 7, 8 or a separate end wall part 7a, 8a respectively appertaining thereto. For this purpose each end wall part 7a, 8a has on its outer face a claw-like holder 20 which is firmly connected thereto and in which an approximately vertical long hole or an approximately vertical slot 21 is machined through which the fixing screw 18 engages so that it can be moved therein in the direction of the double arrow 19. The set screws 17 can also be supported on the claw-like holder 20 in such a way that when these set screws 17 are rotated a delicate, reliable and approximately vertically aligned height adjustment of the plug-in part 16 together with the carrier plates 9 fixed thereon can be achieved in the direction of the double arrow 19, as a result of which - as will be explained in greater detail below -the carrier plates 9 with the small sintered metal plates 11 can be adjusted relative to the roller end faces.

In order to be able to carry out this positioning of the carrier plate 9 and in particular the small sintered metal plates 11 fixed thereon relative to the appertaining roller end faces (cf. 1c and 1d in FIG. 2) simply and reliably, the lower end 16a of each plug-in part 16 (which in this case is constructed like a U-shaped profiled beam) is inserted from above into a sheath-like pocket 22 provided in the appertaining shaft end wall 7, 8 or the end wall part 7a, 8a respectively thereof and—as will be explained below—is guided so as to be slidably movable in the direction of the double arrow 19. The pocket 22 is formed by a channel-shaped recess of approximately U-shaped cross-section (cf. FIG. 4) which is open towards the corresponding roller end faces and closely adapted to the external cross-section of the lower end 16a of the plug-in part. In addition this pocket 22 is located at the lower end of the end wall parts 7a and 8a, and these lower ends can be integral parts of these end wall parts 7a, 8a. However, it is preferably for various reasons for the end walls 7, 8 or the end wall parts 7a, 8a to be provided—as shown in particular in FIG. 1—with lower ends 7a' and 8a' respectively which are releasably fixed thereon (screwed on) and have the said pockets 22.

The lower end 16a of the plug-in part 16 bearing the carrier plate 9 with the small sintered metal plates 11 tapers—as shown in FIGS. 2 and 3—is of a wedge shape in the direction of the appertaining roller end face (1cc or 1d in FIG. 2). The appertaining pockets 22 also taper in a wedge shape in the direction of the appertaining roller end faces at the same wedge angle (angle $\alpha$ in FIG. 2) as the lower end 16a of the plug-in part. Above all a rear cover plate 22a of each pocket 22 extends in a wedge shape in the said manner, whereas each lower end 16a of the plug-in part with its lower U-arm ends 16a' taper downwards in a wedge shape in the said manner and are supported so as to be slidably movable on the rear cover plate 22a of the appertaining pocket 22, and each of these cover plates 22a then forms a sort of guide plate for the lower ends 16a of the plug-in part or the U-arm ends 16a' thereof. Accordingly when the plug-in parts 16 are moved in the direction of the double arrow 19, then by a downward movement of the plug-in part 16 the carrier plate 9 fixed thereon with its small sintered metal plates 11 can be moved against the appertaining end faces of the rollers 1, 2 and vice versa. Thus each plug-in part and in particular the small sintered metal plates 11 borne by it and the carrier plates 9 can be positioned by means of the set screws 17 extremely delicately with against the appertaining end faces of the rotating rollers, and the distance from the cover surface 11a of the small sintered metal plates 11 to the roller end faces should be such that the grinding gap cover which is formed on the one hand does not scrape on the roller end faces but also on the other hand does not form too large a gap with respect to the roller end faces (in order to maintain the desired sealing effect).

What is claimed is:

1. A roller mill for high pressure comminution of material for subsequent grinding comprising a pair of rotatable rollers arranged to define a grinding gap therebetween, material delivery means having wall portions arranged to cover opposite ends of said grinding gap adjacent opposite end face portions of said rollers, each of said wall portions including carrier plate means, positioning means associated with said carrier plate means to position and releasably mount said carrier plate means relative to said roller end face portions, a plurality of wear plates arranged in edge-abutting mosaic pattern mounted on each of said carrier plate means with outer wearing surfaces thereof facing said roller end face portions and said grinding gap ends and inner connection surfaces thereof facing said carrier plate means, and individual releasable wear plate connection means extending between said inner connection surface of each of said wear plates into connecting engagement with a carrier plate for selective and individual mounting and dismounting thereof.

2. The roller mill of claim 1 wherein said wear plates are formed from sintered metal and are of relatively thin rectangular pattern.

3. The roller mill of claim 1 wherein said wear plate connection means is in the form of a flat head screw having its head fixed to the inner connection surface of a wear plate and its shank projecting outwardly from such wear plate at approximately right angles thereto, an aperture in said carrier plate through which said shank projects beyond said carrier plate, and locking means removably threaded on that part of said shank which projects beyond said carrier plate.

4. The roller mill of claim 1 wherein each carrier plate includes a recessed area receiving said wear plates in flush relation with surrounding portions of said carrier plate whereby a tightly closed wear surface is presented to the opposite ends of said grinding gap.

5. The roller mill of claim 4 wherein each carrier plate forms the lower end of a plug-in member in the form of a profiled beam, said carrier plate being retained at the upper end thereof in said beam by height adjusting means, the lower end of said carrier plate being guided by a sheath-like pocket forming a part of a wall portion of said material delivery means, whereby said carrier plate and said wear plates mounted thereon are reciprocably movable relative to said roller end face portions.

6. The roller mill of claim 5 wherein said lower end of said plug-in member and said sheath-like pocket are complementally tapered in the direction toward said roller end face portions.

7. The roller mill of claim 5 including holding means connecting each of said plug-in members to a wall portion of said delivery means, said holding means having guide means permitting controlled limited movable adjustment of said member by said height adjusting means.

* * * * *